US005115755A

United States Patent [19]

Smith

[11] Patent Number: 5,115,755

[45] Date of Patent: May 26, 1992

[54] QUICK ATTACHMENT RELEASE JIB HANDLING AND STOWAGE SYSTEM

[76] Inventor: Gailerd S. Smith, 720 Terry St., Monterey, Calif. 93940

[21] Appl. No.: 507,688

[22] Filed: Apr. 10, 1990

[51] Int. Cl.[5] ..... B63H 9/04

[52] U.S. Cl. ..... 114/105; 114/114

[58] Field of Search ..... 114/39.1, 102, 103, 114/104, 105, 106, 107, 108, 109, 111, 112, 113, 114, 115

[56] References Cited

U.S. PATENT DOCUMENTS

| | | | |
|---|---|---|---|
| 423,859 | 3/1890 | Crowell | 114/114 |
| 2,453,357 | 11/1948 | Barkley | 114/111 |
| 2,925,798 | 2/1960 | Colgate | 114/102 |
| 3,826,223 | 7/1974 | Lingo | 114/114 |
| 3,901,175 | 8/1975 | Wheatley | 114/114 |
| 4,075,966 | 2/1978 | Bates et al. | 114/114 |
| 4,407,212 | 10/1983 | Anderson | 114/114 |
| 4,444,144 | 4/1984 | Kopilak | 114/114 |

*Primary Examiner*—Jesûs D. Sotelo
*Assistant Examiner*—Stephen P. Avila
*Attorney, Agent, or Firm*—Schroeder, Davis & Orliss, Inc.

[57] ABSTRACT

A sail magazine and rigging device for automatically rigging and stowing a stay sail, comprising a elongated flat member having a spear-shaped blade section for catching and opening sail hanks and removing them from the stay. When used on a properly configured vessel, the sail magazine allows the prerigging and interchangeable use of two stay sails without the assistance of additional crew members. The sail magazine includes a sail storage section providing for the retention of sails on the magazine and allowing the use of multiple magazines to facilitate quick exchange of sails and orderly stowing of unused sails.

23 Claims, 7 Drawing Sheets

QUICK ATTACHMENT RELEASE JIB HANDLING AND STOWAGE SYSTEM

BACKGROUND OF THE INVENTION

This invention relates generally to devices for automatically attaching sails to and releasing sails from a stay on a sailboat and, more particularly, relates to a magazine for storing suitably rigged sails in readiness for use and for quickly attaching and releasing the sails from a wire or cable stay.

Sailboats typically use sails, called stay sails, attached to the standing rigging to increase the sail carrying ability of a sailboat. The most common such sail is the jib, a triangular sail rigged to the forestay at the bow of the sailboat. The leading edge or luff of a stay sail is commonly secured to a wire or cable stay by means of spring loaded clips referred to as "hanks" which are attached to the luff of the sail and which clip onto the wire stay. Various types of spring loaded hanks are known, but the most common has a U-shaped portion which fits onto the stay, and which is closed by a spring-loaded piston, the piston being manually retracted to affix or release the sail. To attach a sail to a stay it is necessary to clip the individual sail hanks to the stay one at a time.

Changing wind conditions often dictate or require sail or jib changes to maintain sailing efficiency. Further, the wind forces may require that a sail or jib be changed to maintain boat safety. Conventional methods of changing a sail or jib requiring one or more crewmembers to go to the foredeck, sometimes in rough seas, can be extremely uncomfortable or even hazardous.

In racing sailboats, the time required to change a sail or jib can make a difference in the outcome of the race. In cruising situations involving crewmembers of varying ability and experience, the process of changing a sail or jib can create threats to both the sailboat and the crew safety.

Sailors have sought various means to ease the rigging of stay sails, addressing both the design of the hank and devices to hold the hanks in readiness for use. U.S. Pat. No. 2,925,798 issued on Feb. 23, 1960 to Stephen Colgate discloses a magazine comprising an elongated member of channel cross section upon which the hanks may be preset, such magazine then being placed on or over the stay with all the hanks thereby being positioned for use. When the sail is hoisted each hank in turn slides up and off of the magazine and a spring-loaded latching piston snaps closed, attaching the hank to the stay. This allows a sail to be quickly attached to the stay but does not assist in its removal after use. The magazine must be manually rerigged by a crew member before it can be used with another sail.

U.S. Pat. No. 3,006,308 issued October 31 to Stephen Enke addresses the requirement to both attach and detach a sail. Enke discloses a fixture which is inserted in the stay itself, thereby modifying the stay to provide a thin web which allows a suitably designed hank to pass off the bottom of the fixture and onto a magazine device. To employ the invention disclosed by Enke the stay must be severed at its lower end and the fixture installed between the stay and its anchoring point on the deck. This introduces an additional potential for material failure, where in a major piece of standing rigging such as a forestay such failure could be disastrous for both the sailboat and its crew. Enke further discloses a hank designed to be employed with the fixture. This hank utilizes a narrow gap in the portion of the hank which encloses the stay when the sail is in use. This gap must be small to prevent the stay from being forced through the gap by the forces on the sail but at the same time the gap must be wide enough to pass over the web of the fixture disclosed by Enke. If the gap is widened to accommodate a thicker and therefore stronger fixture web, the likelihood of premature release from the stay increases. If the gap is narrowed to prevent premature release from the stay, the web must be likewise thinned, increasing the likelihood of failure of the fixture and thereby the stay.

U.S. Pat. No. 3,251,329 issued on May 17, 1966 to Graydon Smith discloses a jib attachment system which utilizes a fixture inserted between the end of a stay and its anchoring point on the deck and a suitably designed hank for use therewith. The fixture disclosed by Smith utilizes an off-axis track which guides the hank to a disconnect feature of the fixture. The axis defined by the stay itself is interrupted by the track, necessitating a second portion of the fixture to anchor the stay to the sailboat in line with the stay. This requires suitably strong materials which can withstand the forces placed on the device. As this apparatus is to be used in a wet or saltwater environment the material must also be corrosion resistant. Smith teaches that many such corrosion resistant materials are unsuitable for swaging onto a stay. Smith therefore further teaches an additional means to join suitable materials by threaded fittings to arrive at an apparatus which is sufficiently ductile at one point for attaching the stay thereto and sufficiently strong at another point to accommodate a thin web to allow disconnection of the hank from the stay. The apparatus as disclosed by Smith introduces off axis forces placed on the fixture, and an additional joint in the axis of the stay, both contributing to an increase in the potential for failure of the stay. The hank disclosed by Smith has an opening or gap in the perimeter of the portion which grips the stay when the sail is in use. This opening must be large enough to pass over the web of the fixture and, while the gap is displaced from the strain axis exerted by the sail to reduce the tendency of the stay to slip out of the opening, the same tradeoff shortcomings vis a vis the thickness of the fixture web are encountered as described hereinabove with regard to the hank disclosed by Enke.

U.S. Pat. No. 3,826,211 issued Jul. 30, 1974 to Jacob Hirsch discloses a single piece hank having a longitudinal channel for gripping the stay and an off-axis slot to allow passage of the stay when the hank is installed or removed from the stay. To attach the hank to a stay the crew member turns each hank to align the slot with the stay, passes the stay through the slot and into the longitudinal channel and realigns the hank to the stay. An additional feature disclosed by Hirsch allows one hank to turn another when the former is brought into contact with the latter hank, thereby automatically releasing the second hank from the stay. This allows a second sail to be raised and automatically displace a previous sail which then must be retrieved and manually prepared for reuse. No provision is suggested by Hirsch to allow for alternating between the two sails without rerigging the displaced sail by a crew member.

SUMMARY OF THE INVENTION

A quick release sail stowage system constructed in accordance with the principles of the present invention includes a sail stowage magazine comprising an elongated, generally flattened member having a substantially straight lower section for stowing a number of said clips or hanks thereon and an upper curved blade section for receiving the sail hanks. The curved blade section is shaped, being wider at a central portion thereof, such as an arrow head or spear head, thus providing an opening and closing action for a hank as the hank is slidingly passed over the magazine blade section allowing the hank to be attached to or released from a stay. The lower section of the magazine terminates in a mounting block or base retaining the sail hanks on the magazine.

In a sailboat equipped according to the present invention the jib stowage magazine is removably attached to the sailboat deck at the foot of the forestay with the open portion of the curved blade section facing generally aft and the forestay closely adjacent and tangent to the curved blade section. A sail is attached to the magazine by sliding suitably designed sail hanks having a sail attached thereto over the blade section in normal sequence. The sail is then rigged in the customary manner with a hoisting line or halyard attached to the head of the sail and downhaul line at the tack of the sail. When the sail is hoisted the magazine guides each hank to the forestay and allows the hank to automatically close around the stay. When the sail is retrieved by pulling on the downhaul line the hanks slide down the forestay and are received by the magazine blade section which both opens the hank and guides it clear of the stay and onto the lower section of the magazine. With the sail thus retrieved, the sequence may be repeated as desired.

The quick release jib stowage system of the present invention further includes sail hanks for attaching the jib sail to the forestay and which, in cooperation with the jib magazine described above, can be quickly and easily attached to and removed from the forestay. The sail hank comprises a pair of hooked arm members pivotally coupled together at the ends of the arm members opposite the hook end. The arm members are spring-loaded to a closed configuration forming an opening or loop through which the stay passes. The diameter of the opening is larger than the thickness of the stay thus allowing the hank to slide freely on the stay. The hook portions of the arm members overlap forming a generally V-shaped section of the hank opening for receiving the stay when the sail is under tension thus preventing the hank from opening and inadvertently releasing from the stay. The arm members further form a second opening for receiving the magazine blade section which is adapted to open the hank in cooperation with the magazine blade as the hank slides over the wider portion of the hank blade.

The jib stowage system of the present invention provides an apparatus which greatly reduces the time required and minimizes the difficulties of setting a jib or other sail. The magazine provides convenient stowage and placement of a jib and, by prerigging two or more magazines with different sails, allows the quick change of sails while sailing or racing. Further, in combination with well-known deck track and shuttle systems, the jib stowage magazine may be rigged to allow a single crew member to change and set the jib without leaving the boat cockpit.

DESCRIPTION OF THE DRAWING

A fuller understanding of the present invention will become apparent from the following detailed description taken in conjunction with the accompanying drawing which forms a part of the specification and in which.

DETAILED DESCRIPTION OF THE PREFERRED EMBODIMENT

Figure 1:
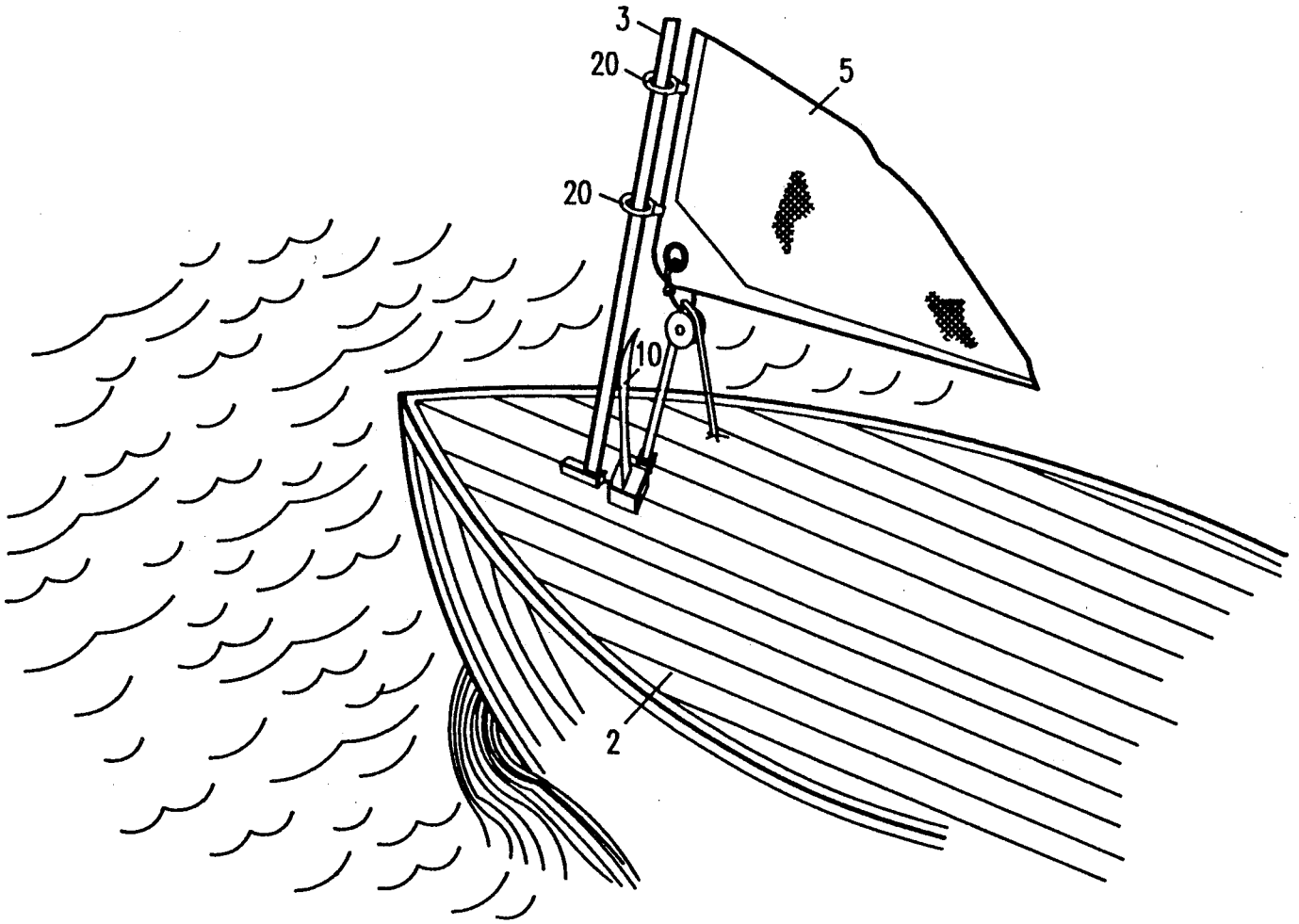
FIG. 1 is a perspective view of the bow area of a sailboat equipped with a quick release jib stowage system constructed in accordance with the principles of the present invention.

Referring now to FIGS. 1 and 2, a quick release jib stowage system constructed in accordance with the principles of the present invention is shown. A stay sail 5, such as a jib, is equipped with suitable hanks 20, hereinafter described, and prerigged on a jib stowage magazine 10. Magazine 10 comprises an elongated, generally flat, longitudinally curved spear-shaped piece of metal or other material of suitable strength and rigidity. The lower end of magazine 10 is mounted on a mounting block or base 2 attached to the deck 1 near the foot of the forestay 3. The base 2 may be an integral part of the magazine 10 with the base 2 being removably attached to the deck 1. Alternatively, the base 2 may comprise a mounting block 2 attached to the sailboat deck with the magazine 10 removably attached thereto by well-known releasable means, such as a dovetail fitting or a tongue and groove fitting, for example. Mounting block 2 may be provided with a securing eye 4 for attaching the tack or bottom corner of the leading edge of the sail 5. This allows the sail to be prerigged to the magazine 10 for quickly changing one sail for another. Alternatively, securing eye 4 may be deleted and the tack secured to the stay deck anchor in a conventional manner.

Figure 2A:
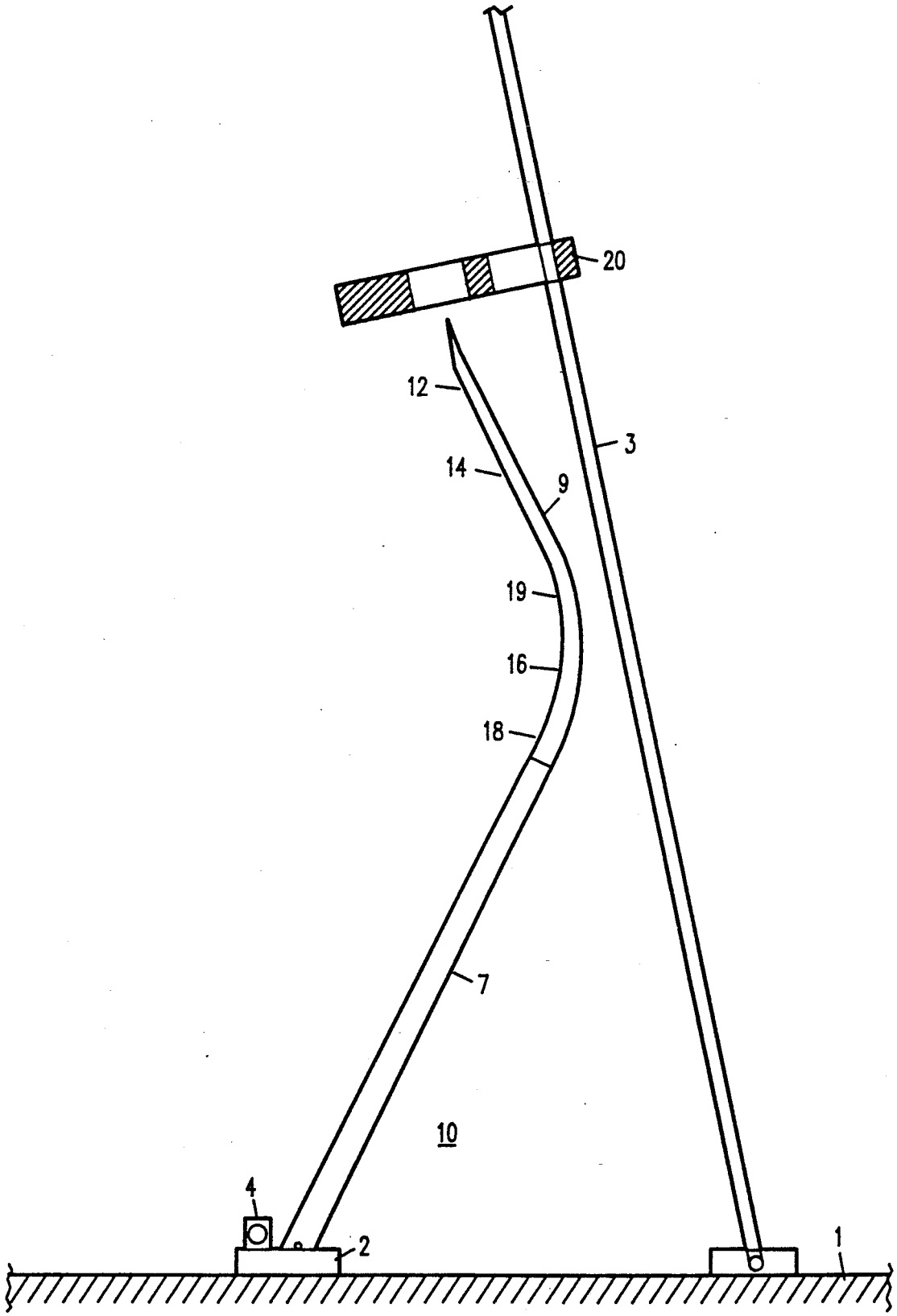
FIG. 2A is a side view of the sail magazine of the quick release jib stowage system shown in FIG. 1 in place near the forestay of a sailboat.
Figure 2B:
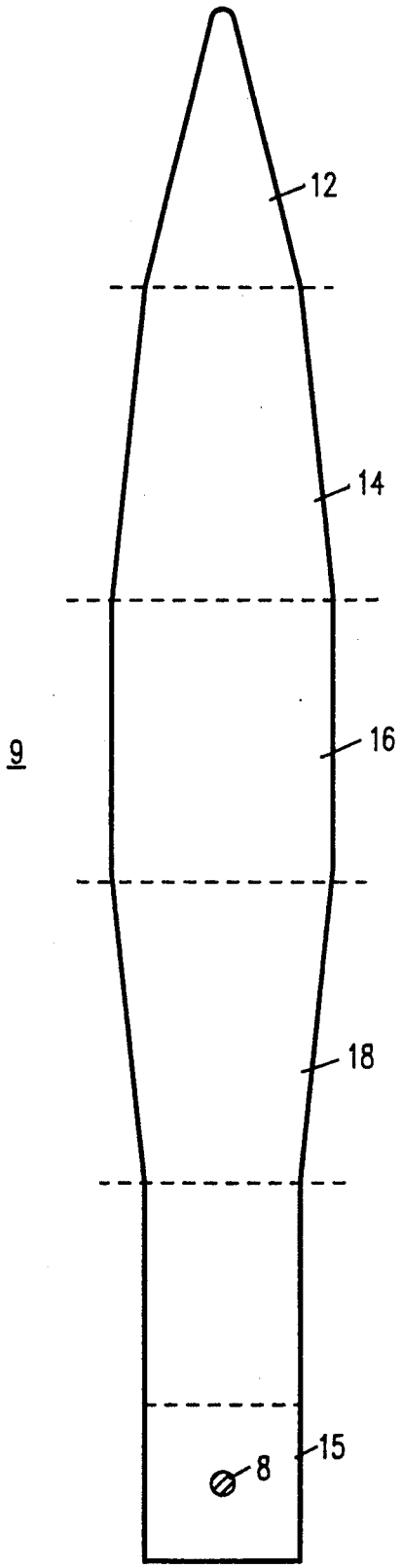
FIG. 2B is a plan view of the blade section of the jib magazine shown in FIG. 2A.

As shown in FIGS. 2A and 2B, the jib magazine 10 comprises a generally straight lower stowage section 7 and a curved blade section 9. The curved blade section 9 is shaped to provide for opening and closing of a sail hank 20 as the hank 20 slides over the blade section 9. The blade tip segment 12 is tapered both in thickness and width from a blunted point to a width of approximately 1 inch. Tapered segment 14 of the blade 9 is of even thickness and continues to gently taper to a width of approximately 1 ¾ inch. Straight segment 16 is of even width of approximately 1¾ inch while tapered segment 18 gently tapers from 1¾ inch to approximately 1 inch transitioning from the blade section 9 to the jib stowage section 7. The lower stowage section 7 is approximately 1 inch in width having a length of 1 to 3 feet as required by the size of sail to be rigged on the magazine 10.

Figure 2C:
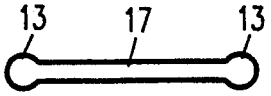
FIG. 2C is a cross-sectional view of the jib magazine shown in FIG. 2A.
Figure 2D:
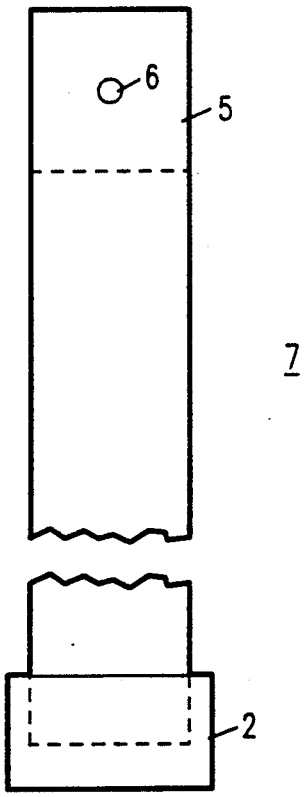
FIG. 2D is a plan view of the separate stowage section shown in FIG. 2A.
Figure 2E:
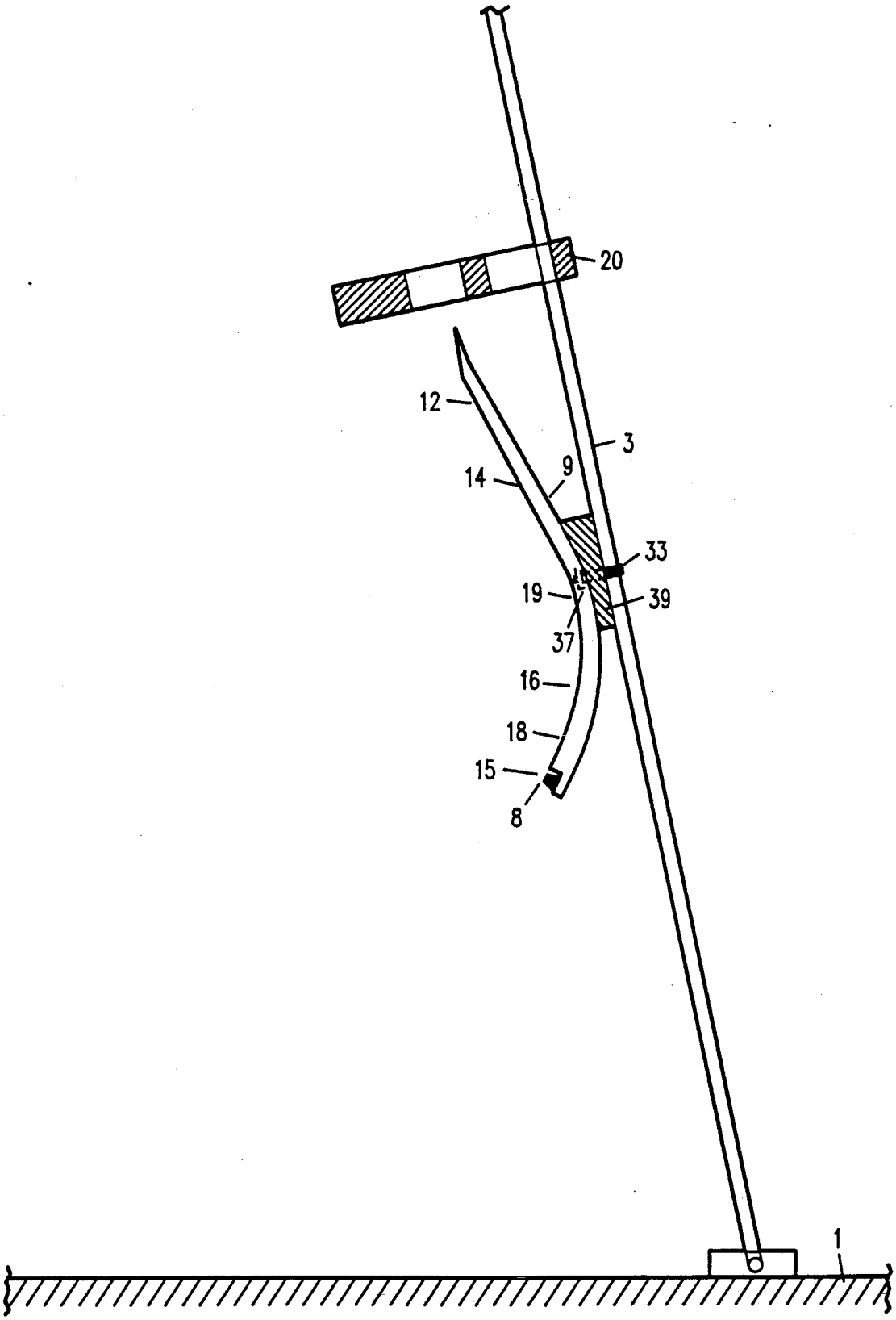
FIG. 2E is a side view of the separate blade section shown in FIG. 2A attached to the forestay.

Referring now also to FIGS. 2C, 2D and 2E, the jib magazine 10 is fabricated from aluminum or stainless steel or other suitable material as a single, unitary piece 10 or in two, interlocking sections 7, 9. For example, the blade section 9 may be formed with its lower end 15 having a reduced thickness and a locking pin 8 protruding from the surface thereof. Preferable, the locking pin 8 protrudes normal to the blade lower end 15 surface and towards the center of the curve 19. Similarly, the stowage section 7 is formed with its upper end 5 having a reduced thickness with an aperture 6 therethrough adapted for engaging the locking pin 8 thereby attaching the stowage section 7 to the lower end 15 of the blade section. The locking pin 8 may be a post, such as a rivet protruding through an aperture (not shown) in the blade lower end 15, or it may be a bolt and nut allowing the jib magazine to be assembled as a single, integral piece. The locking pin 8 preferably comprises a tapered post ensuring that the stowage section 7 is properly centered when the post 8 is received in aperture 6.

Figure 3:
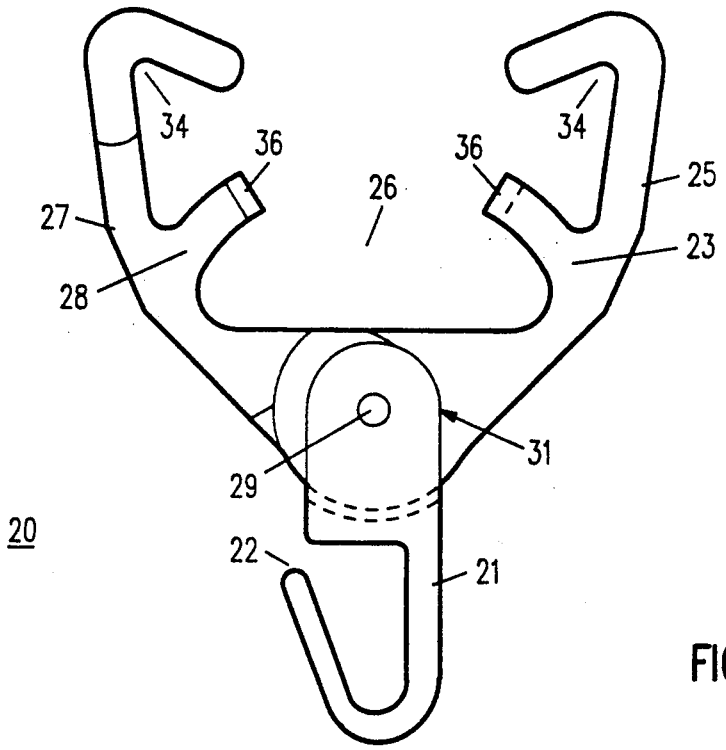
FIG. 3 is a plan view of a sail hank shown in an open configuration constructed in accordance with the principles of the present invention.
Figure 4:
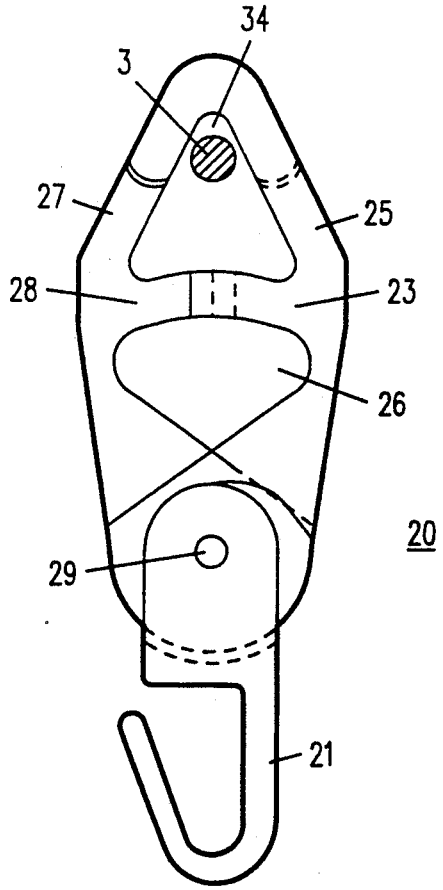
FIG. 4 is a plan view of the sail hank of FIG. 3 shown in a closed configuration.
Figure 5A:
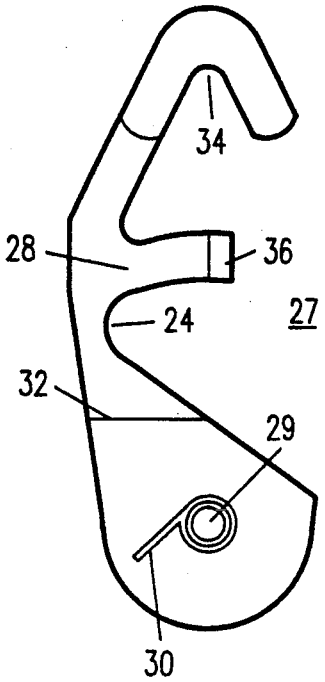
FIGS. 5A and 5B are a plan view illustrating the arm members of the sail hank shown in FIG. 3.
Figure 5B:
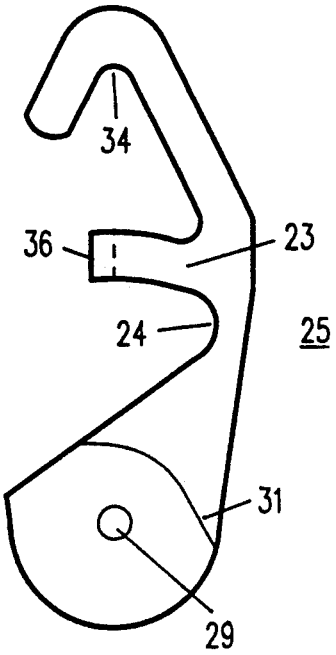
Figure 5C:
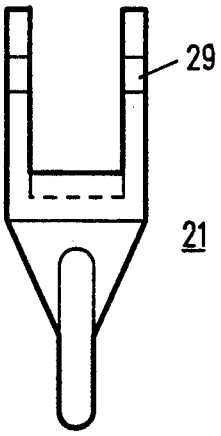
FIGS. 5C and 5D are front and side views, respectively, illustrating the sail attachment hook of the sail hank shown in FIG. 3.
Figure 5D:
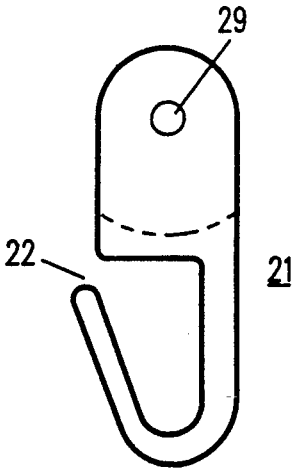

As the stay sail is lowered, the hanks 20 are engaged, one by one, by the magazine blade section 9. Tip segment 12 is rounded and tapered as shown to easily enter the sword opening 26 of hank 20 as will be described in greater detail herein below. The blunted, rounded tip 12 also is safety feature to prevent injury to crew members. Tapered segment 14 of blade 9 is dimensioned to open the hank 20 as the hank slides down the magazine 10. The blade straight segment 16 retains the hank suitably open for disengaging of the hank 20 from the stay 3. Tapered segment 18 of the blade 9 allows the hank to return to the closed position as the hank continues down the magazine. The blade section 9 is curved as shown in order to move the hank 20 relative to stay 3 forcing the hank up and out of contact with the stay 3 as the hank slides down the blade section 9. In operation, as hank 20 slides down stay 3 it is engaged by blade tip segment 12, blade segment 14 forces the hank 20 open and moves it closer to the stay 3 to relieve any strain on hank 20 and to move stay 3 out of the hank arm curved hook portions 34 (as shown in FIGS. 3, 4 and 5). The concave curve 19 is dimensioned so as to begin the movement of the opened hank 20 away from stay 3 just as the hank is fully opened, allowing hank 20 to clear stay 3. As hank 20 continues down the magazine 10 it is drawn clear of stay 3 and returns to the closed position as it passes over tapered segment 18. When clear of the stay 3, each hank 20 drops down over the magazine lower section 7 where the hanks are retained by the magazine base 2. As the sail 5 is raised, each hank passes up the magazine 10, is opened at segment 18, brought in proximity of stay 3 at segment 16 and closes around stay 3 as it passes over segment 14. As shown in FIG. 2C, the edges of the magazine 10 are rolled or molded to form a beaded edge 13. Rounded bead 13 provides additional strength to web 17, especially in the tapered and curved segments of the blade section 9 where the forces required to move the hank 20 up and off of the stay 20 may be considerable under heavy wind conditions. The beaded edge 13 is also provides a smooth sliding surface to receive hank 20. The width of the magazine 10 is selected within the range of one to five inches to correspond to the dimensions of the hanks as determined by the sail size and is preferably one and one-half inches to two inches at its maximum width at the blade segment 16. The concave curve 19 preferably has a radius of curvature of approximately 3 inches.

In one preferred embodiment, as illustrated in FIG. 1, the jib stowage magazine 10 is used as a single unit which is positioned aft of the forestay 3 with the forestay 3 adjacent and tangent to the blade curve 19 to allow the rigging or unrigging of a stay sail (such as a jib). When not in use, the jib stowage magazine 10 is removed from the vicinity of the forestay. Alternatively, in a second preferred embodiment, the separate blade section 9 is rigidly attached to the forestay 3 by a U-bolt 33 and nuts 37, for example, such that the forestay 3 is tangent to the curve 19 with the curve 19 facing aft. A block or spacer 39 clamped between the forestay 3 and the blade section 9 provides the proper spacing between the forestay 3 and the blade section 9 to allow for proper functioning of the hank 20 as it slides over the blade section 9. When it is desired to raise or lower a stay sail, the lower or jib stowage section 7 is then removeably attached to the blade section 9 at its lower end 15, the post 8 being engaged in aperture 6.

Referring now to FIGS. 3–5, a sail hank 20 constructed in accordance with the principles of the present invention is shown. Sail hank 20 comprises a pair of generally curved hooked arm members 25, 27 pivotally coupled together at their ends opposite the hooked ends 34 at pivot point 29. A sail attachment hook 21 pivotally coupled to the arm members 25, 27 at the pivot 29 serves to attach the hank 20 to the leading edge or luff of the sail 5. Hank arm 25 and 27 are pivotally joined to hook 21 by use of a suitable fastener means such as a rivet, bolt or clevis pin. Tensioning spring 30 is held in place by the fastener means at pivot point 29 and bears on stop surfaces or shoulders 31 and 32 to bias hank arm members 25 and 27 in the normally closed position. If the sail 5 is provided with grommets for attaching hanks, said grommets may be passed through opening 22 which then may be closed by bending or crimping hook 21. If the sail 5 is designed such that hanks must be sewn on, hook 21 is bent closed to form a loop through which the sewing thread may be passed. The hank 20 encircles and grasps the stay 3 when arms 25 and 27 are closed to form the stay opening 35. The diameter of the stay opening 35 is larger than the stay 3 thickness so that the hank may slide freely thereon. Hank arm members 25 and 27 overlap when closed so that the curved hook portions 34 form a V-shape in the stay opening 35 for receiving stay 3 when the sail 5 is under tension, thus providing a locking force to keep the hank closed and prevent inadvertent release when in use. Curved hook portion 34 of stay opening 35 is preferably dimensioned to the same radius as the stay 3 to provide maximum contact area between the stay 3 and hank 20, but curved portion 34 may be either smaller or larger than the stay thickness and still function properly. Hank arm projections 23 and 28 have overlapping tapered ends 36 to provide a smooth closure for stay opening 35 and to form magazine opening 26. Magazine opening 26 is dimensioned to engage the magazine blade 9 and fully open the hank when passing over blade segment 16 as described hereinabove. When a sail 5 is lowered, blade tip segment 12 engages magazine opening 26 as the hank 20 slides down the stay 3. Curved segment 24 on hank arm members 25 and 27 is dimensioned to correspond to the magazine rounded bead 13 to provide a smooth bearing surface. As hank 20 continues to slide down the magazine blade section 9, arms 25 and 27 open around pivot point 29, allowing the hank to be withdrawn from the stay 3 as described hereinabove. As the sail is raised, the hank 20 is opened by tapered segment 18 of blade 9 and positioned by straight segment 16 on the stay 3 with the stay 3 within the stay opening 35. The hank 20 closes over the stay 3 as it passes over tapered portion 14 and blade tip 12 on magazine 10 thus attaching the sail to stay 3. Shoulders 31 and 32 are formed on hank arms 25 and 27 such that they engage the hook 21 preventing hank 20 from opening wide enough to allow the magazine 10 to pass between hank arm projection ends 36. The dimensions of the spacer 39 (as shown in FIG. 2E) are determined by the thickness of the hank arm projections 23, 28 and the width of the opening between the hank arm projection ends 36.

Figure 6:
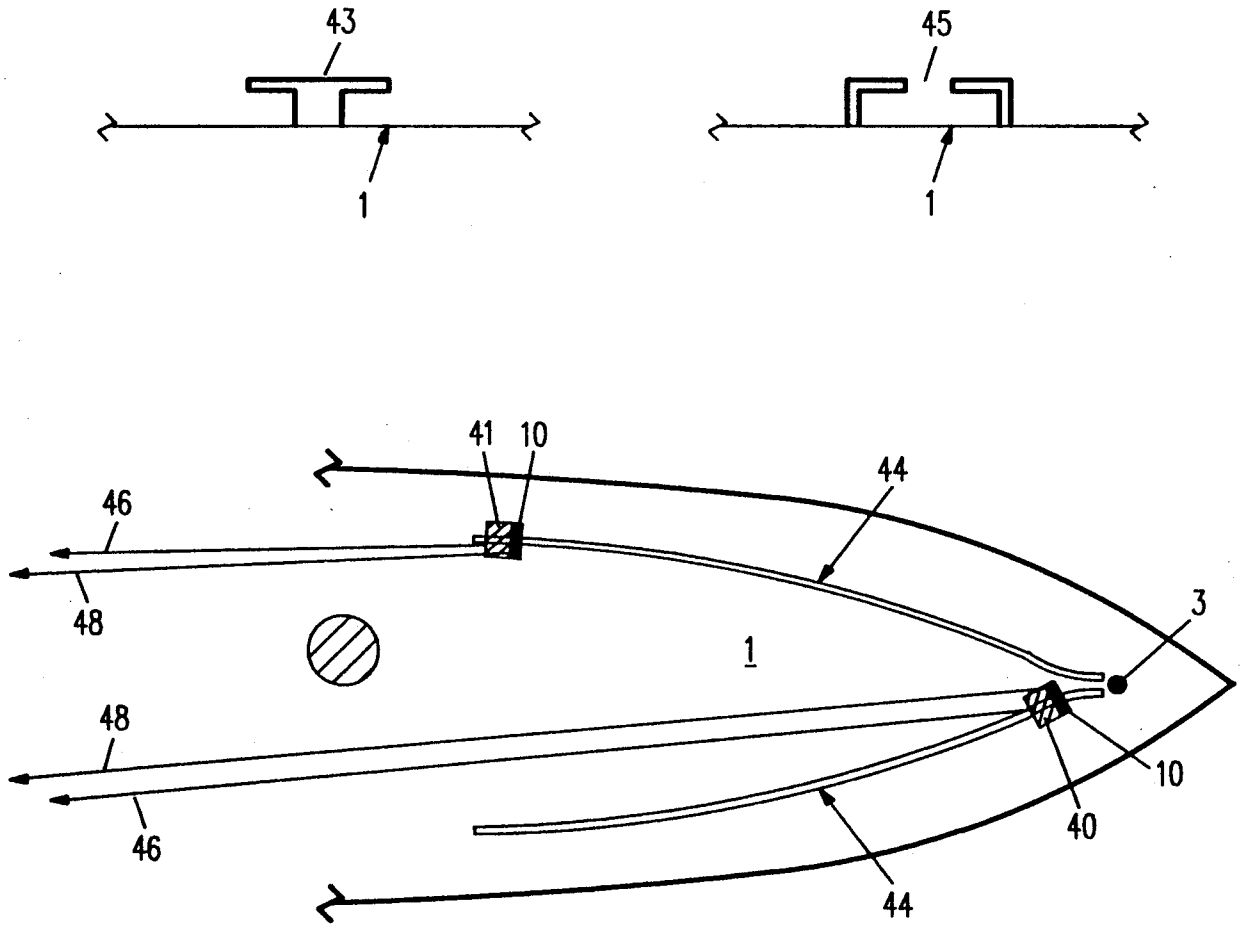
FIG. 6 is a plan view of the forward deck area of a sailboat equipped with a pair of quick release jib stowage systems in accordance with the principles of the present invention.

Referring now to FIG. 6, the forward deck of a sailboat equipped with two jib stowage magazines 10 is shown. Tracks 44 are fastened as shown along the outer portion of deck 1. Tracks 44 may be of any conventional design such as the tee track 43 or, alternatively, the channel track 45. Magazine mounting block or base 2 is removably attached to a shuttle 40, 41 which is of suitable design to function with the track 44. In use, shuttles 40 and 41 are positioned on the track 44 in the approximate positions shown. Suitable rigging, such as a stainless steel cable, couples the shuttles 40 and 41 together and runs either inside channel track 45 or along the outboard edge of tee track 43, passing over a suitable pulley (not shown) where the tracks 44 come together adjacent the foot of the forestay 3. A shuttle haul line 46 is rigged between each shuttle 40, 41 and the sailboat cockpit to allow the crew to position the shuttle 40, 41 without leaving the cockpit. A stowage magazine blade section 9 is attached to the forestay 3 (as shown in FIG. 2E). The desired sails (not shown) are each rigged on a jib stowage section 7 of magazine 10 which is then secured to a shuttle 40 or 41. Each sail must be fully rigged with its own halyard, downhaul and sheets. With a sail thus rigged on each shuttle, the crew member may select either sail by positioning the appropriate shuttle at the forward extremity of the track 44, coupling the jib stowage section 7 to the lower end 15 of the blade section 7, and raising the sail with the appropriate halyard. The forward end of each track 44 is disposed such that the jib stowage section 7 approaches the forestay 3 on an axis parallel to the sailboat longitudinal centerline thus ensuring proper engagement with the blade section lower end 15. To change sails, the sail in use is lowered with the assistance of the downhaul line 48 and is secured in an orderly manner on the jib stowage section 7. When the first sail is thus secured, it is moved out of the way by retrieval of the haul line 46 attached to its shuttle. Retrieval of the first shuttle moves the second shuttle into position because of the interconnecting rigging as described above. When the second sail is in position it is raised as described hereinabove. This operation may be repeated as desired by the crew.

Alternatively, each of the shuttles 40, 41 may be rigged with a single piece, integral jib magazine 10 which is moved into and held in position adjacent forestay 3 by the shuttle haul lines 46.

Several jib stowage magazines 10 may be prerigged with sails. When the crew wishes to change from one sail to another, the sail in use is lowered and stacked in an orderly manner on the magazine 10 in use. The magazine 10 and sail may then be detached from the mounting block 2 and another prerigged magazine positioned in its place. The sail halyard and sheets are switched from the first sail to the second and the new sail is then ready for use.

Although the present invention has been shown and described with reference to a preferred embodiment, it will be readily apparent to those skilled in the art that various changes in form and arrangement of the components may be made without departing from the spirit of the invention, or exceeding the scope of the appended claims.

I claim:

1. A sail setting apparatus for affixing a sail to or removing a sail from a rigging line of a vessel, comprising:

a magazine for receiving sail hanks, and at least one sail hank, each said sail hank having an openable loop for receiving a rigging line, said sail hank adapted for cooperation with said magazine whereby said openable loop is opened by passing said sail hank over said magazine.

2. A sail setting apparatus as in claim 1 wherein said magazine comprises a shaped blade section tapering from a blunt point to a first segment having a first predetermined width thence further tapering to a second segment having a second predetermined width, said second predetermined width being less than said first predetermined width, each said sail hank adapted for cooperation with said blade section whereby said openable loop is opened and then closed as said sail hank is slidingly passed over said shaped blade section.

3. A sail setting apparatus as in claim 2 wherein said magazine further includes an elongated stowage section coupled to a lower end of said blade section, said stowage section for receiving and retaining said sail hanks from said blade section.

4. A sail setting apparatus as in claim 3 wherein said sail hank includes a magazine loop for slidingly receiving said blade section, said magazine loop adapted for cooperation with said blade section for opening and closing said openable loop as said sail hank is slidingly passed over said blade section, said magazine loop for retaining said sail hank on said magazine stowage section.

5. A sail setting apparatus as in claim 3 wherein said magazine further includes a base means attached at a lower end of said stowage section, said base means preventing said sail hanks from sliding off said lower end of said stowage section, said base means for removably mounting said magazine to a deck of a vessel.

6. A sail setting apparatus as in claim 2 wherein said magazine blade section is longitudinally curved providing relative movement of said sail hank with respect to said rigging line whereby said rigging line is repositioned within said openable loop as said sail hank is passed over said blade section.

7. A sail setting apparatus as in claim 4 wherein said sail hank comprises a pair of arm members pivotally coupled together at one end and each of said arm members having a generally curved hook formed at the other end thereof, said curved hook ends forming said openable loop when said pair of arm members are pivoted to a closed configuration.

8. A sail setting apparatus as in claim 7 wherein said sail hank includes spring means adapted to provide a force urging said pair of arm members to said closed configuration.

9. A sail setting apparatus as in claim 8 wherein said curved hook ends overlap when said sail hank is in said closed configuration thereby forming a V-shaped indentation in said openable loop perimeter, said V-shaped indentation for receiving said rigging line, said rigging line bearing against opposing sides of said openable loop thus preventing said sail hank from being inadvertently opened and releasing said rigging line.

10. A sail setting apparatus as in claim 9 wherein said magazine blade section is longitudinally curved providing relative movement of said sail hank with respect to said rigging line as said sail hank is slidingly passed over said blade section, said V-shaped identation allowing said openable loop to be opened as said sail hank is passed over said blade section.

11. A sail setting apparatus as in claim 3 wherein said magazine is fabricated as a unitary piece.

12. A sail setting apparatus as in claim 3 wherein:

said shaped blade section includes first locking means formed at said lower end; and said elongated stowage section includes second locking means at an upper end thereof, said first locking means adapted to engage said second locking means releasably coupling said shaped blade section and said elongated stowage sections together at said lower and upper ends, respectively.

13. A sail setting and stowage system for affixing a sail to or removing a sail from a stay on a vessel, said system comprising:

at least one track means attached to a deck of a sailboat, said track means having a shuttle means movably mounted thereon;

a sail magazine for receiving and retaining sail hanks, said sail magazine removably mounted at a lower end thereof to said shuttle means;

a plurality of sail hanks, each said sail hank having an openable loop for receiving a stay, said sail hank adapted for cooperation with said sail magazine whereby said openable loop is opened by passing said sail hank over said sail magazine; and said track means adapted for positioning said shuttle means and said sail magazine adjacent the lower end of a stay.

14. A sail hank for removably attaching a sail to a rigging line on a vessel, comprising:

a pair of arm members pivotally coupled together at one end thereof, each of said pair of arm members having a curved hook formed at the other end thereof, said curved hook ends forming a first loop when said sail hank is in a closed configuration, said first loop for receiving a rigging line;

biasing means coupled to said pair of arm members biasing said pair of arm members to said closed configuration;

each said arm member including an inwardly projecting member disposed intermediate the ends thereof and opposing to the inwardly projecting member of the other arm member forming a second loop, said second loop adapted for cooperation with an expansion means for opening said first loop; and attachment means for attaching said sail hank to a sail.

15. A sail hank as in claim 14 wherein said attachment means comprises hook means pivotally coupled to said coupled ends of said pair of arm members.

16. A sail hank as in claim 15 wherein said hook means is attached to said sail by crimping said hook means to said sail.

17. A sail hank as in claim 14 wherein said arm member curved hook ends overlap when said sail hank is in said closed configuration.

18. A sail hank as in claim 17 wherein said overlapping curved hook ends form a V-shaped indentation in the perimeter of said first loop, said V-shaped indentation for receiving said rigging line, said rigging line in contact with opposing surfaces of said curved hook ends preventing said sail hank from opening.

19. A sail magazine for storing a sail and for affixing a sail to and removing a sail from a rigging line of a vessel, said sail magazine comprising:

a shaped blade section adapted for cooperation with a sail hank, said sail hank having an openable loop for receiving a rigging line, said openable loop being opened and then closed as said sail hank is slidingly passed over said shaped blade section; and an elongated stowage section coupled to a lower end of said shaped blade section, said stowage section for receiving and retaining one or more sail hanks from said shaped blade section.

20. A sail magazine as in claim 19 further comprising a base means coupled to a lower end of said stowage section, said base means for retaining said sail hanks on said stowage section and for removable mounting said sail magazine to a vessel.

21. A sail magazine as in claim 19 wherein said shaped blade section tapers from a blunt point at an upper end thereof to a first segment having a predetermined width thence further tapering to a second segment having a second predetermined width, said second predetermined width being less than said first predetermined width.

22. A sail magazine as in claim 19 wherein:

said shaped blade section includes first locking means formed at said lower end thereof; and said elongated stowage section includes second locking means at an upper end thereof, said first locking means adapted for engaging said second locking means for releasably coupling said shaped blade section and said elongated stowage sections together at said lower and upper ends, respectively.

23. A sail magazine as in claim 19 wherein said sail magazine is fabricated as a unitary piece.

* * * * *